US011255077B2

(12) United States Patent
Tan

(10) Patent No.: US 11,255,077 B2
(45) Date of Patent: Feb. 22, 2022

(54) DEODORANT SEWER PIPE

(71) Applicant: JIANGMEN SURRAIN SHOWER CO., LTD., Guangdong (CN)

(72) Inventor: Jingwen Tan, Guangdong (CN)

(73) Assignee: JIANGMEN SURRAIN SHOWER CO., LTD., Jiangmen (CN)

( * ) Notice: Subject to any disclaimer, the term of this patent is extended or adjusted under 35 U.S.C. 154(b) by 0 days.

(21) Appl. No.: 17/068,265

(22) Filed: Oct. 12, 2020

(65) Prior Publication Data

US 2022/0025623 A1 Jan. 27, 2022

(30) Foreign Application Priority Data

Jul. 21, 2020 (CN) ..... 202010705850.7

(51) Int. Cl.
*E03C 1/122* (2006.01)
*E03C 1/294* (2006.01)
*E03C 1/29* (2006.01)

(52) U.S. Cl.
CPC ..... *E03C 1/122* (2013.01); *E03C 1/29* (2013.01); *E03C 1/294* (2013.01)

(58) Field of Classification Search
CPC ..... E03C 1/122
USPC ..... 4/222, 111.1, 220, 221, 261, 294, 309, 4/459, 464; 422/1, 243; 510/109, 382, 510/440, 447
See application file for complete search history.

(56) References Cited

U.S. PATENT DOCUMENTS 4,262,372 A * 4/1981 Ryder ..... E03D 9/02 4/222
4,910,808 A * 3/1990 Roth ..... B65D 83/28 222/182
5,577,673 A * 11/1996 McMurphy ..... E03C 1/2665 241/33
5,940,894 A * 8/1999 Cruz ..... E03C 1/126 4/222
6,526,598 B1 * 3/2003 Black ..... F03D 9/20 4/214
10,392,788 B2 * 8/2019 Chen ..... E03F 5/042
2017/0204593 A1 * 7/2017 Chen ..... E03D 11/00

FOREIGN PATENT DOCUMENTS

CN 211774247 U * 10/2020

* cited by examiner

*Primary Examiner* — Lori L Baker
(74) *Attorney, Agent, or Firm* — Bayramoglu Law Offices LLC

(57) ABSTRACT

A quick-assembly deodorant drainer for washbasin. The deodorant drainer comprises a drainer body including a mounting portion mounted in a water outlet of the washbasin and extends downward, a connecting portion mounted at a lower end of the mounting portion and is provided with a deodorant anti-overflow device, and a sewer pipe connected to a lower end of the connecting portion, shaped as a cylindrical straight pipe, and is provided with at least one bending portion. Wherein, the deodorant anti-overflow device includes a cylinder and a sealing cover, an upper end of the cylinder is open and a water-flow hole is disposed at a lower end thereof, and a cylindrical convex portion is disposed at an inner bottom portion of the cylinder and extends upwardly; the convex portion is internally provided with a through hole, and the sealing cover is disposed at the bottom of the cylinder.

10 Claims, 5 Drawing Sheets

DEODORANT SEWER PIPE

CROSS-REFERENCE TO RELATED APPLICATIONS

The present application is based upon and claims priority of Chinese Patent Application No. 202010705850.7, filed before Chinese Patent Office on Jul. 21, 2020. The entire contents of which is incorporated herein by reference.

TECHNICAL FIELD

The present disclosure relates to the technical field of sanitary ware, and in particular to a deodorant sewer pipe.

BACKGROUND

Deodorant sewer pipes in the related art are usually configured to have a S-bend and a P-bend, in which deodorization is achieved through water sealing. However, if the sewer pipe is not used for a long period of time, the water will dry up so that the deodorization cannot be achieved, and a situation of foreign matter blockage will occur.

SUMMARY

To this end, the present disclosure provides a deodorant sewer pipe to solve the problem that the water will dry up and the deodorization cannot be achieved if the deodorant sewer pipes in the related art are not used for a long period of time.

In order to achieve the above object, the present disclosure provides the following technical solutions.

According to the present disclosure, a deodorant sewer pipe is provided, which includes a sewer pipe body, a universal sewer pipe and a deodorizer, wherein the sewer pipe body is connected to the universal sewer pipe, and the deodorizer is disposed in an interior of the sewer pipe body; the deodorizer includes a spring and a cover, and the spring is sleeved over the cover; when there is a water flow, the spring and the cover move downward to achieve drainage, and when there is no water flow, the cover is reset through an elastic force of the spring so as to block the sewer pipe body and achieve deodorization.

Further, the cover includes a connecting portion and a blocking portion, wherein the connecting portion is disposed perpendicular to the blocking portion; the connecting portion is cylindrical, and the spring is sleeved over a side face of the connecting portion.

Further, the blocking portion is in the shape of a disc, and a material thereof is silica gel or plastic.

Further, the deodorant sewer pipe further includes a screw, which is installed on the connecting portion and installed in an axial direction of the connecting portion.

Further, the deodorant sewer pipe further includes a first O-ring, which is disposed on a connection face of the sewer pipe body and the universal sewer pipe.

Further, the deodorant sewer pipe further includes a second O-ring and a universal sewer pipe adapter, and the second O-ring is disposed on a connection face of the universal sewer pipe and the universal sewer pipe adapter.

Further, the deodorant sewer pipe further includes a third O-ring, which is disposed on a side face of the universal sewer pipe adapter.

Further, the number of the third O-ring is more than one, and the third O-rings are disposed at intervals on the side face of the universal sewer pipe adapter.

Further, the deodorant sewer pipe further includes a hexagonal adapter and a hexagonal lock nut, wherein the hexagonal lock nut is connected to an upper end of the sewer pipe body, and the hexagonal adapter is installed inside the hexagonal lock nut.

Further, the deodorant sewer pipe further includes a first rubber pad and a second rubber pad; the first rubber pad is disposed inside the hexagonal adapter, and the second rubber pad is disposed on a connection face of the hexagonal adapter and the hexagonal lock nut.

The present disclosure has the following advantages.

In the present disclosure, by disposing the deodorizer in the interior of the sewer pipe body, an automatic blocking and deodorization can be achieved under the action of the spring. When there is a water flow passing through, the cover and the spring will move downward under the action of the gravity of the water flow, and the spring will be compressed so that water flows out all around the cover to achieve drainage. When there is no water flow, the spring will change from the compressed state to a free state, so that the cover is reset and blocking is achieved, thereby preventing the odor from upsurging. The phenomenon that the water will dry up in the toilet and the deodorization cannot be achieved if the deodorant sewer pipe is not used for a long period of time can be avoided, and there will be no blockage of foreign objects.

BRIEF DESCRIPTION OF THE DRAWINGS

The accompanying drawings that are required to be used in the description of the embodiments of the present disclosure or the conventional technology are described briefly below, so that the technical solutions according to the embodiments of the present disclosure or according to the conventional technology will become clearer. It is apparent that the accompanying drawings in the following description are only illustrative. For those skilled in the art, other accompanying drawings may be obtained according to these drawings provided, without any creative work.

The structure, proportion, size and the like shown in the present specification are only used to cooperate with the contents disclosed in the specification for those skilled in the art to understand and read, and are not intended to limit the conditions with which the present disclosure can be implemented. Therefore, they have no practical significance in a technical sense. Any modification to the structure, any change of the proportions or any adjustment of the size should fall within the scope covered by the technical contents disclosed in the present disclosure without affecting the effects and objects that can be achieved by the present disclosure.

Figure 1:
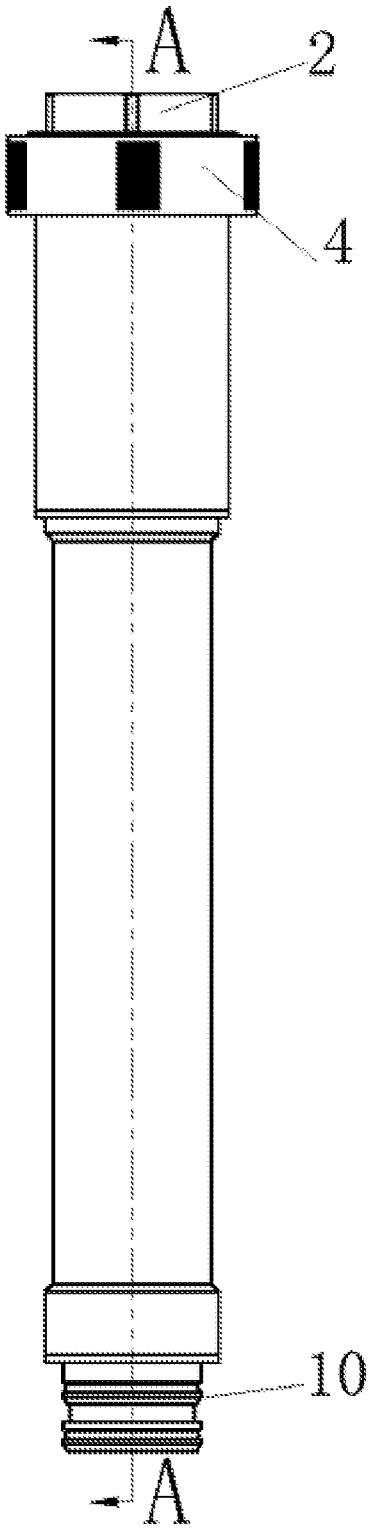
FIG. 1 is a schematic view showing an overall structure of a deodorant sewer pipe according to an exemplary embodiment.

In the drawings: 1: first rubber pad; 2: hexagonal adapter; 3: second rubber pad; 4: hexagonal lock nut; 5: deodorizer; 51: cover; 511: connecting portion; 512: blocking portion; 52: spring; 6: sewer pipe body; 7: first O-ring; 8: universal sewer pipe; 9: second O-ring; 10: universal sewer pipe adapter; 11: third O-ring; 12: screw.

DETAILED DESCRIPTION

The implementations of the present disclosure is described in the specific embodiments below, and other advantages and functions of the present disclosure can be readily understood by those skilled in the art from the contents disclosed in the specification. It is apparent that the described embodiments are part of the embodiments of the present disclosure, instead of all of them. All the other embodiments obtained by those skilled in the art on the basis of the embodiments of the present disclosure without creative efforts will fall within the scope of protection of the present disclosure.

Figure 2:
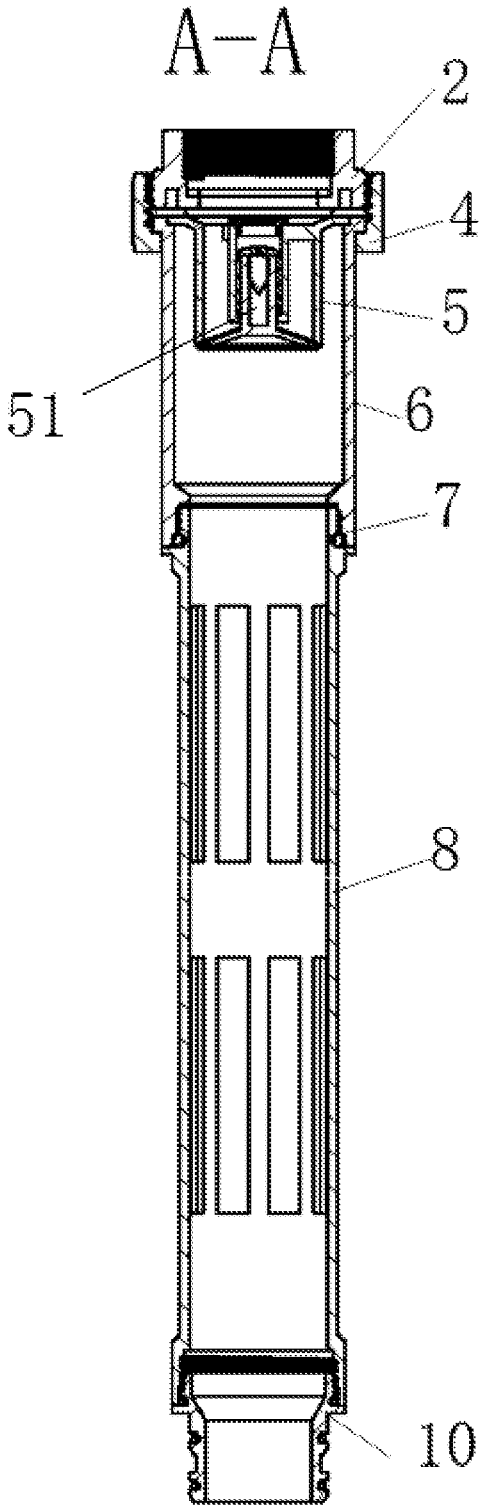
FIG. 2 is a cross-sectional view taken along line A-A in FIG. 1.
Figure 3:
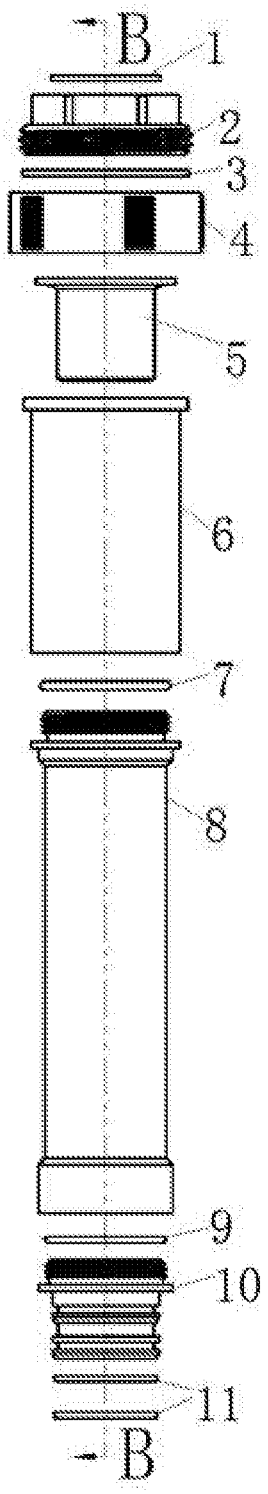
FIG. 3 is a schematic view showing an exploded structure of a deodorant sewer pipe according to another exemplary embodiment.
Figure 4:
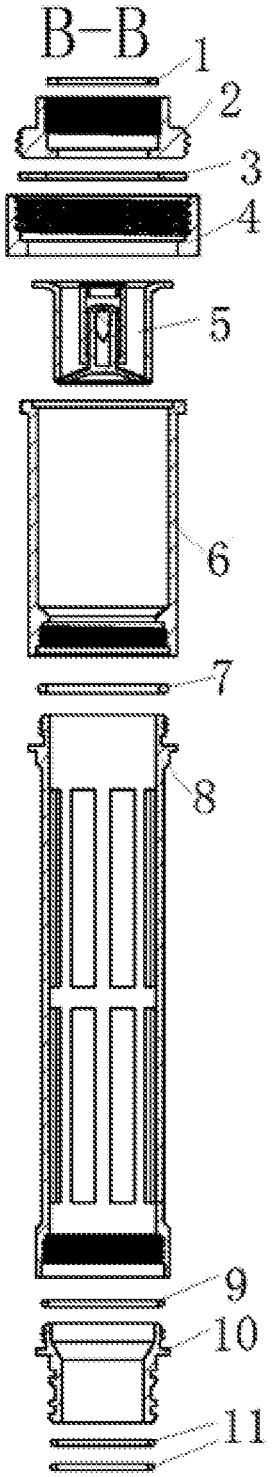
FIG. 4 is a cross-sectional view taken along line B-B in FIG. 3.
Figure 5:
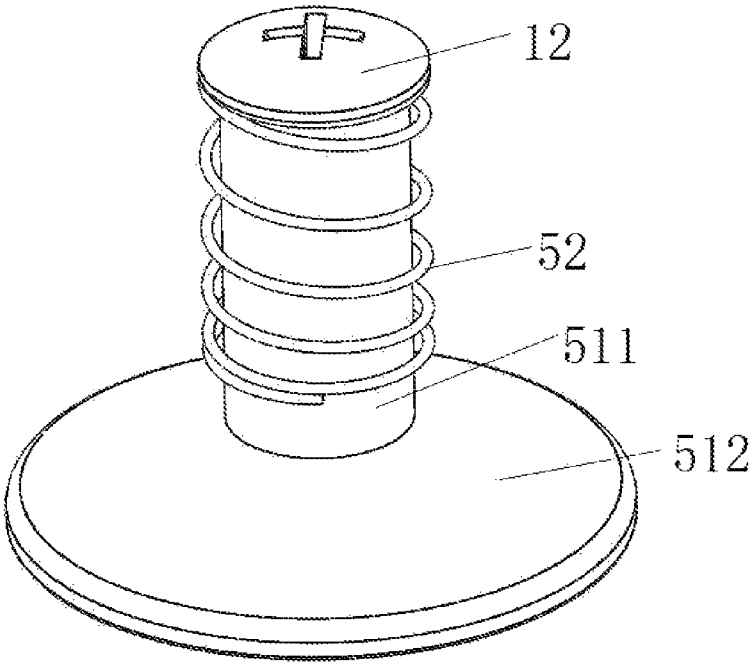
FIG. 5 is a schematic view showing an internal structure of a deodorizer according to an exemplary embodiment.

According to an embodiment of the present disclosure, a deodorant sewer pipe is provided; as shown in FIGS. 1 to 5, the deodorant sewer pipe includes: a sewer pipe body 7, a universal sewer pipe 8 and a deodorizer 5, wherein the sewer pipe body 6 is connected to the universal sewer pipe 8, and the deodorizer 5 is disposed in an interior of the sewer pipe body 6; the deodorizer 5 includes a spring 52 and a cover 51, and the spring 52 is sleeved over the cover 51; when there is a water flow, the spring 52 and the cover 51 move downward to achieve drainage, and when there is no water flow, the cover 51 is reset through an elastic force of the spring 52 so as to block the sewer pipe body 6 and achieve deodorization.

In the embodiment of the present disclosure, by disposing the deodorizer 5 in the interior of the sewer pipe body 6, an automatic blocking and deodorization can be achieved under the action of the spring 52. When there is a water flow passing through, the cover 51 and the spring 52 will move downward under the action of the gravity of the water flow, and the spring 52 will be compressed so that water flows out all around the cover 51 to achieve drainage. When there is no water flow, the spring will change from the compressed state to a free state, so that the cover 51 is reset and blocking is achieved, thereby preventing the odor from upsurging. The phenomenon that the water will dry up in the toilet and the deodorization cannot be achieved if the deodorant sewer pipe is not used for a long period of time can be avoided, and there will be no blockage of foreign objects.

In some optional embodiments, the cover 51 includes a connecting portion 511 and a blocking portion 512, wherein the connecting portion 511 is disposed perpendicular to the blocking portion 512; the connecting portion 511 is cylindrical, and the spring 52 is sleeved over a side face of the connecting portion 511. The blocking portion 512 is in the shape of a disc, and its material is silica gel or plastic. A circumferential edge of the blocking portion 512 is in contact with a housing of the deodorizer 5 to prevent the odor from upsurging.

A screw 12 is installed on the connecting portion 511 and installed in an axial direction of the connecting portion 511. The screw 12 may be a cross screw, and the position of the cover 51 may be adjusted by the screw 12.

In some optional embodiments, the deodorant sewer pipe further includes a first O-ring 7, which is disposed on a connection face of the sewer pipe body 6 and the universal sewer pipe 8 to achieve sealing.

In some optional embodiments, the deodorant sewer pipe further includes a second O-ring 9 and a universal sewer pipe adapter 10, and the second O-ring 9 is disposed on a connection face of the universal sewer pipe 8 and the universal sewer pipe adapter 10 to achieve sealing.

In some optional embodiments, the deodorant sewer pipe further includes a third O-ring 11, which is disposed on a side face of the universal sewer pipe adapter 10 to achieve sealing.

In some optional embodiments, the number of the third O-ring 11 is more than one, e.g., two, and the third O-rings 11 are disposed at intervals on the side face of the universal sewer pipe adapter 10. Corresponding installation grooves are provided in the side face of the universal sewer pipe adapter 10, into which the third O-rings 11 may be placed. The third O-rings 11 may be used as a quick-plug anti-leakage device to be inserted into a drainage pipe on the ground or in the wall. As compared with the existing products, the installation is faster and more convenient, and there is no need for glass glue for fixing.

In some optional embodiments, the deodorant sewer pipe further includes a hexagonal adapter 2 and a hexagonal lock nut 4, wherein the hexagonal lock nut 4 is connected to an upper end of the sewer pipe body 6, and the hexagonal adapter 2 is installed inside the hexagonal lock nut 4.

The deodorant sewer pipe also includes a first rubber pad 1 and a second rubber pad 3; the first rubber pad 1 is disposed inside the hexagonal adapter 2, and the second rubber pad 3 is disposed on a connection face of the hexagonal adapter 2 and the hexagonal lock nut 4. The specific material of the rubber pads may be nitrile rubber.

The materials of the first O-ring 7, the second O-ring 9 and the third O-ring 11 may each be silicone or rubber to achieve sealing.

While the present disclosure is described in detail with reference to the specific embodiments and general description above, it is apparent to those skilled in the art that some modifications or improvements may be made on the basis of the present disclosure. Therefore, such modifications or improvements made without departing from the spirit of the present disclosure will all fall within the scope of protection of the present disclosure.

What is claimed is:

1. A deodorant sewer pipe, comprising: a sewer pipe body, a universal sewer pipe and a deodorizer, wherein the sewer pipe body is connected to the universal sewer pipe, and the deodorizer is disposed in an interior of the sewer pipe body; the deodorizer comprises a spring and a cover, and the spring sleeves over the cover;

wherein when water flows, the spring and the cover move downward to achieve drainage, and when water flow does not flow, the cover resets through an elastic force of the spring to block the sewer pipe body and causes deodorization.

2. The deodorant sewer pipe according to claim 1, wherein the cover comprises a cylindrical connecting portion and a blocking portion, the connecting portion is disposed perpendicular to the blocking portion, and the spring sleeves over a side face of the connecting portion.

3. The deodorant sewer pipe according to claim 2, wherein the blocking portion is disc shaped, and a material thereof is silica gel or plastic.

4. The deodorant sewer pipe according to claim 2, further comprising a screw on the connecting portion and in an axial direction of the connecting portion.

5. The deodorant sewer pipe according to claim 1, further comprising a first O-ring on a connection face of the sewer pipe body and the universal sewer pipe.

6. The deodorant sewer pipe according to claim 5, further comprising a second O-ring and a universal sewer pipe adapter, wherein the second O-ring is on a connection face of the universal sewer pipe and the universal sewer pipe adapter.

7. The deodorant sewer pipe according to claim 6, further comprising at least one third O-ring on a side face of the universal sewer pipe adapter.

8. The deodorant sewer pipe according to claim 7, wherein the the at least one third O-ring comprises a plurality of third O-rings, and the plurality of third O-rings are at intervals on the side face of the universal sewer pipe adapter.

9. The deodorant sewer pipe according to claim 1, further comprising a hexagonal adapter and a hexagonal lock nut, wherein the hexagonal lock nut is connected to an upper end of the sewer pipe body, and the hexagonal adapter is located inside the hexagonal lock nut.

10. The deodorant sewer pipe according to claim 9, further comprising a first rubber pad and a second rubber pad, wherein the first rubber pad is located inside the hexagonal adapter, and the second rubber pad is located on a connection face of the hexagonal adapter and the hexagonal lock nut.

* * * * *